US005642622A

United States Patent [19]

Berchowitz et al.

[11] Patent Number: 5,642,622

[45] Date of Patent: Jul. 1, 1997

[54] REFRIGERATOR WITH INTERIOR MOUNTED HEAT PUMP

[75] Inventors: David M. Berchowitz; Dale E. Kiikka, both of Athens, Ohio

[73] Assignee: Sunpower, Inc., Athens, Ohio

[21] Appl. No.: 516,355

[22] Filed: Aug. 17, 1995

[51] Int. Cl.[6] ..... F25B 9/00

[52] U.S. Cl. ..... 62/6; 62/444

[58] Field of Search ..... 62/6, 444

[56] References Cited

U.S. PATENT DOCUMENTS

| | | | |
|---|---|---|---|
| 1,669,141 | 2/1928 | Orr . | |
| 1,736,635 | 2/1929 | Steenstrup . | |
| 2,859,595 | 11/1958 | Murphy et al. | 62/444 |
| 2,964,912 | 4/1960 | Roeder, Jr. . | |
| 3,821,881 | 7/1974 | Harkias . | |
| 4,843,826 | 7/1989 | Malaker | 62/6 |
| 5,082,335 | 1/1992 | Cur et al. . | |
| 5,125,241 | 6/1992 | Nakanishi et al. . | |
| 5,127,235 | 7/1992 | Nakanishi et al. . | |
| 5,335,508 | 8/1994 | Tippmann . | |

*Primary Examiner*—Ronald C. Capossela

*Attorney, Agent, or Firm*—Frank H. Foster; Kremblas, Foster, Millard & Pollick

[57] ABSTRACT

A refrigerator having a heat pump mounted within the insulated portion of the refrigerator cabinet which is cooled by the heat pump. The heat pump is a Stirling cycle or Rankine cycle heat pump, is used to cool the interior of the refrigerator cabinet, and is mounted in an insulated housing to limit the transfer of heat from the heat pump into the refrigerator cabinet. A heat transporting conduit connects the heat pump to an exterior heat exchanger mounted outside the refrigerator cabinet.

32 Claims, 7 Drawing Sheets

REFRIGERATOR WITH INTERIOR MOUNTED HEAT PUMP

TECHNICAL FIELD

The invention relates to the field of refrigerators cooled by heat pumps.

BACKGROUND ART

Refrigerators have evolved from wooden boxes cooled by a large block of ice to well-insulated appliances cooled by heat pumps. The heat pumps used to remove heat from the interior of the thermally insulated enclosure were first mounted to the top, exterior surface of the cabinet, but were later moved to a chamber beneath the enclosed cabinet.

A conventional refrigerator 10 is shown in FIG. 1. The refrigerator 10 is made up of a rectangular parallelepiped cabinet 12 with a hinged door 14 enclosing the cabinet 12. A recess 16 is formed in the lower rear of the refrigerator 10 and houses a heat pump 18. The heat pump 18 in a typical refrigerator is a conventional Rankine cycle compressor which compresses a refrigerant, the temperature of which increases upon compression. The hot refrigerant is sent through an external heat exchanger 20, and heat is removed by convection currents passing over the heat exchanger 20. The cooled, compressed refrigerant then passes through an orifice into a chamber where it expands and the temperature drops substantially. This cooled, expanded refrigerant then passes through an internal heat exchanger 22. Heat is absorbed from the interior of the refrigerator 10 as the air within the cabinet 12 passes over the cooled heat exchanger 22. The operating temperature of the heat pump 18 is substantially greater than the desired temperature within the refrigerator 10.

The sidewalls of the cabinet 12 and the door 14 are insulated to prevent the flow of heat into the interior of the refrigerator cabinet 12. The heat pump 18 is placed outside the insulated cabinet 12 to keep the heat pump's 18 heat from the cooled cabinet 12, and in the recess 16 to hide the heat pump from view. However, this recess 16 consumes internal volume and increases manufacturing expense. The bends of the refrigerator cabinet, which are necessary to form the recess, may also reduce the insulating properties of the cabinet.

Many improvements have been made to refrigerators, but the heat pump which cools the primary chamber of the cabinet has always been left outside of the insulated cabinet.

U.S. Pat. No. 2,964,912 to Roeder, Jr. discloses thermoelectric devices mounted on the refrigerator doors which, under the Peltier effect, remove heat from chambers formed in the doors and release it to the main refrigerator compartment. These thermoelectric devices make the door chambers cooler, thereby reducing food spoilage in a part of the refrigerator which is usually susceptible to warming because of adjacent thinner insulation and leaks at the door/cabinet seal. The thermoelectric devices act as auxiliary, non-mechanical heat pumps which supplement a primary compressor type heat pump which cools the main compartment.

U.S. Pat. No. 3,821,881 to Harkias discloses similar thermoelectric devices mounted in the door of a refrigerator. The thermoelectric devices cool the interior chamber of the refrigerator and transfer the heat to the exterior of the refrigerator cabinet. The heat dissipation side of the thermoelectric devices is placed outside of the cold chamber of the refrigerator cabinet.

U.S. Pat. No. 1,669,141 to Orr and U.S. Pat. No. 1,736,635 to Steenstrup show prior art refrigerators.

U.S. Pat. No. 5,082,335 to Cur et al. discloses insulating walls for a refrigerator cabinet, as an attempt to increase insulating efficiency.

In U.S. Pat. Nos. 5,127,235 and 5,125,241, Nakanishi et al. disclose noise reduction devices for quieting the operation of a refrigerator. The devices monitor the frequency of refrigerator noise and produce similar noise which is one-half cycle out of phase with the refrigerator generated noise. Destructive interference reduces the noise.

In U.S. Pat. No. 5,335,508, Tippmann shows the use of a pair of cooling systems used simultaneously to increase the efficiency of operation.

In all conventional refrigerators, the heat pump which moves heat energy from the cooled chamber of a refrigerated cabinet to the exterior of the cabinet is mounted outside of the cooled cabinet. In one device, the cooled part of a secondary, Peltier effect heat pump is inside the cooled chamber, but the heat dissipating portion of the secondary heat pump is mounted outside of the cooled chamber of the refrigerator (e.g. Harkias). Another (Roeder, Jr.) uses thermoelectric, Peltier effect heat pumps within the cooled chamber, but these thermoelectric heat pumps merely supplement the primary, mechanical heat pump outside of the cooled chamber.

The placement of the heat pump outside of the cooled cabinet interior has been thought necessary to maintain the highest efficiency refrigerator, since by definition a portion of the heat pump system has an elevated temperature with respect to the cooled chamber from which the heat pump removes heat. Therefore, it is conventionally assumed that keeping the heat pump outside of the cooled chamber results in the greatest cooling efficiency. On the contrary, substantial unexpected benefits are obtained by placing a well-insulated heat pump within the refrigerated cabinet.

BRIEF DISCLOSURE OF INVENTION

A cooling apparatus is disclosed, comprising a thermally insulated receptacle having a closure. A heat pump is mounted within the receptacle, and a heat transporting apparatus is connected to the heat pump. The heat transporting apparatus has an external portion positioned outside the receptacle and an internal portion positioned inside the receptacle and connected to the heat pump for transporting heat energy from the heat pump to the exterior of the receptacle.

The invention contemplates a mechanical heat pump, preferably a Stirling cycle heat pump, and a heat transporting apparatus including a fluid conduit. A fluid is contained within the fluid conduit and the conduit extends between the heat pump and an external heat exchanger.

Figure 3:
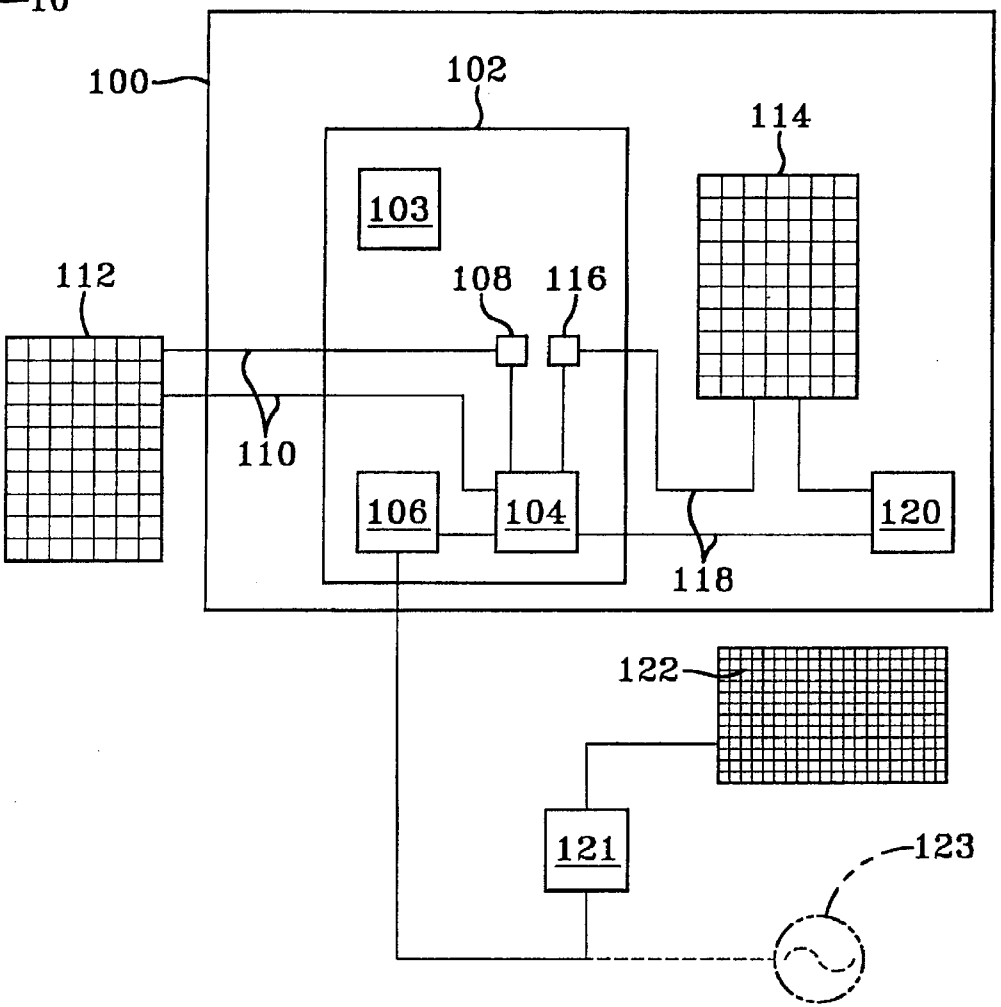
FIG. 3 is a diagrammatic illustration of the preferred embodiment of the present invention.
Figure 1:
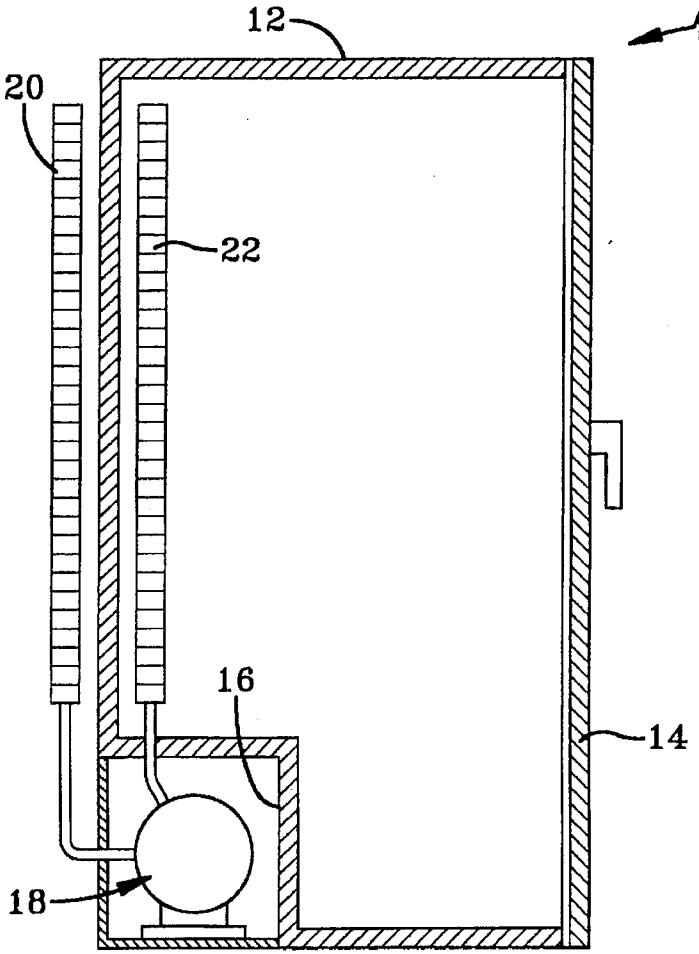
FIG-1 PRIOR ART
FIG. 1 is a side view in section illustrating a prior art refrigerator.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

Figure 2B:
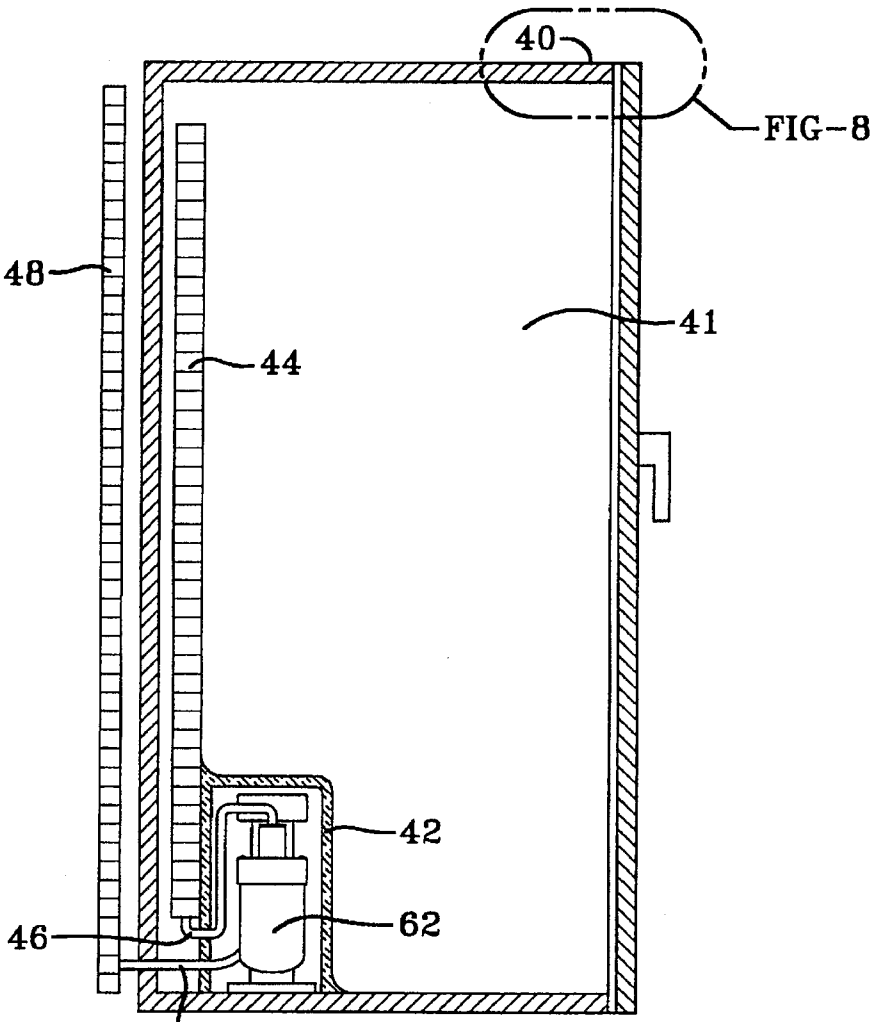
FIG. 2B is a side view in section illustrating a preferred embodiment of the present invention.
Figure 2A:
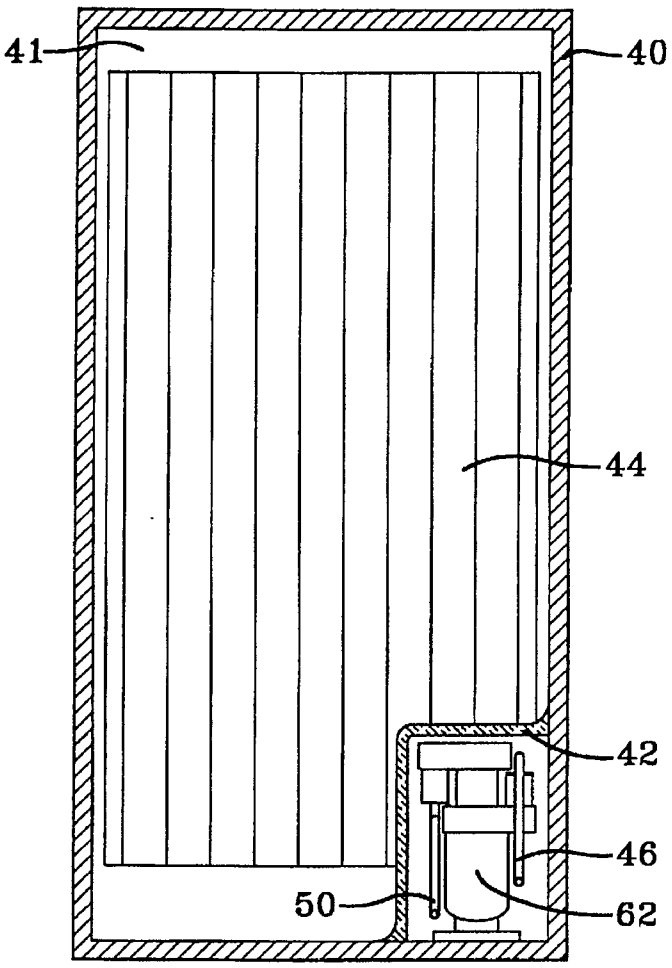
FIG. 2A is a front view in section illustrating a preferred embodiment of the present invention.
Figure 8:
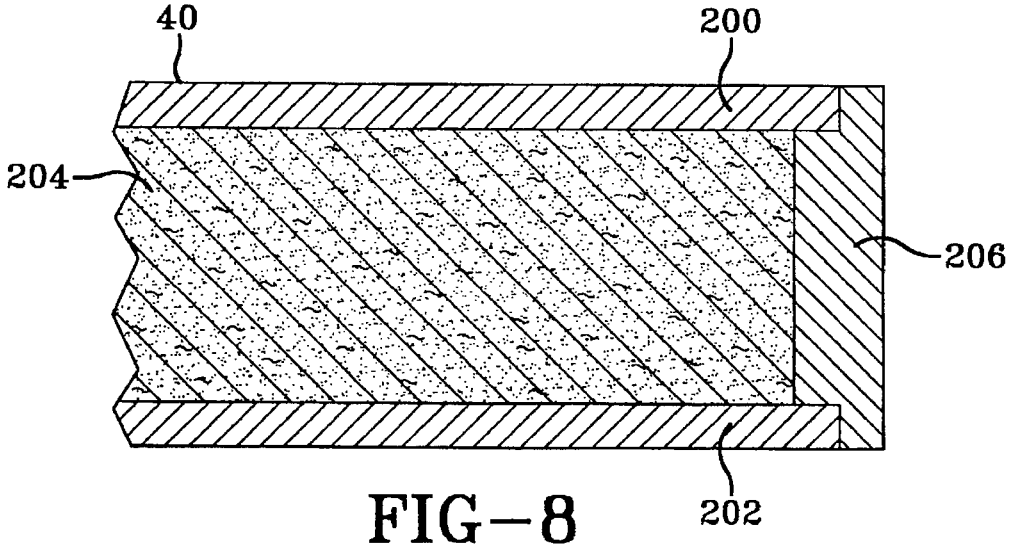
FIG. 8 is a view in section illustrating the structure of the refrigerator cabinet.

An embodiment of the invention, shown in FIG. 2, includes a refrigerator cabinet 40 having an insulated heat pump housing 42 placed within its interior, cooled chamber 41. The refrigerator cabinet 40 (the encircled region of FIG. 2 is shown in FIG. 8 in section) is preferably made of an outer stainless steel box 200 positioned around a smaller, inner stainless steel box 202 of approximately 270 liters of volume, both boxes in the shape of a rectangular parallelepiped. The interstitial space between the boxes is filled with diatomaceous earth 204 under a hard vacuum. The edges of the two boxes are joined with a thin membrane structure 206 for keeping conduction losses to a minimum and maintaining the vacuum. The overall wall thickness is between 1 and 3 centimeters and one small hole in the cabinet is provided for a power line and heat rejection conduit (discussed below). Refrigerator cabinet and insulating technology is disclosed in U.S. Pat. Nos. 4,349,051 and 4,417,382 to Schilf, and 5,066,437 and 5,084,320 to Banito et al., which are incorporated by reference.

The refrigerator cabinet 40 could use the conventional cabinet structure (a steel shell with blown foam insulation). However, since the vacuum insulated cabinets made with fewer bends and welds are less expensive and potentially more reliable than when made for conventional cooling installations, this type of cabinet would be of particular advantage to the present invention.

The heat pump housing 42 is mounted to the cabinet 40 within the lower rear corner of the cooled interior 41, and insulates the heat of the heat pump 62 housed therein from the interior of the cabinet 40. The housing 42 prevents, or at least substantially limits, heat pumped from the chamber 41 and heat generated by the internal friction and electrical resistive losses of the heat pump 62 from warming the interior of the cabinet 40. The housing 42 containing the heat pump 62 also serves to protect the heat pump 62 from contact with objects placed in the cabinet 40, but its primary function is to insulate the heat of the heat pump 62 from dissipation into the cooled interior 41 of the cabinet 40. The insulation of the housing 42 can be of any conventional type. For example, expanded polymer (such as polystyrene) can be used for a low operating temperature heat pump (such as a Stirling cycle), or, for a high operating temperature heat pump (such as a Rankine cycle), an evacuated space between housing 42 layers similar to that of the refrigerator cabinet 40. The amount and placement of insulation is determined by the operating temperature of the heat pump and the localization of the warm (relative to the cooled chamber 41) portions of the heat pump. For example, since a Stirling cycle heat pump has a cool end and a warm end which are distinct from one another, the cool end can be left uninsulated and only the warm end insulated. However, the warm end may also be substantially uninsulated since its heated portion is localized and can be cooled relatively easily.

It would seem disadvantageous to place a device, at least a portion of which has an operating temperature higher than the cooled, interior chamber of a refrigerator, into that part of the refrigerator. This has been the traditional assumption: the high temperature heat pump must be kept outside of the cooled cabinet interior. However, unexpected benefits arise from placing the heat pump inside the refrigerator which offset the anticipated disadvantages of such a configuration. The advantages are particularly substantial when the preferred embodiment of the present invention is used. An understanding of the different embodiments of the invention is helpful to an understanding of its advantages.

The preferred heat pump for use in the present invention is a free piston, Stirling cycle, mechanical heat pump, although any other conventional mechanical heat pump (such as the Rankine cycle) would work. Since the Stirling cycle heat pump has a free piston and displacer, which are supported by gas bearings, and the entire unit is hermetically sealed in a housing, it is inexpensive and operates with substantial reliability and high efficiency.

Figure 4A:
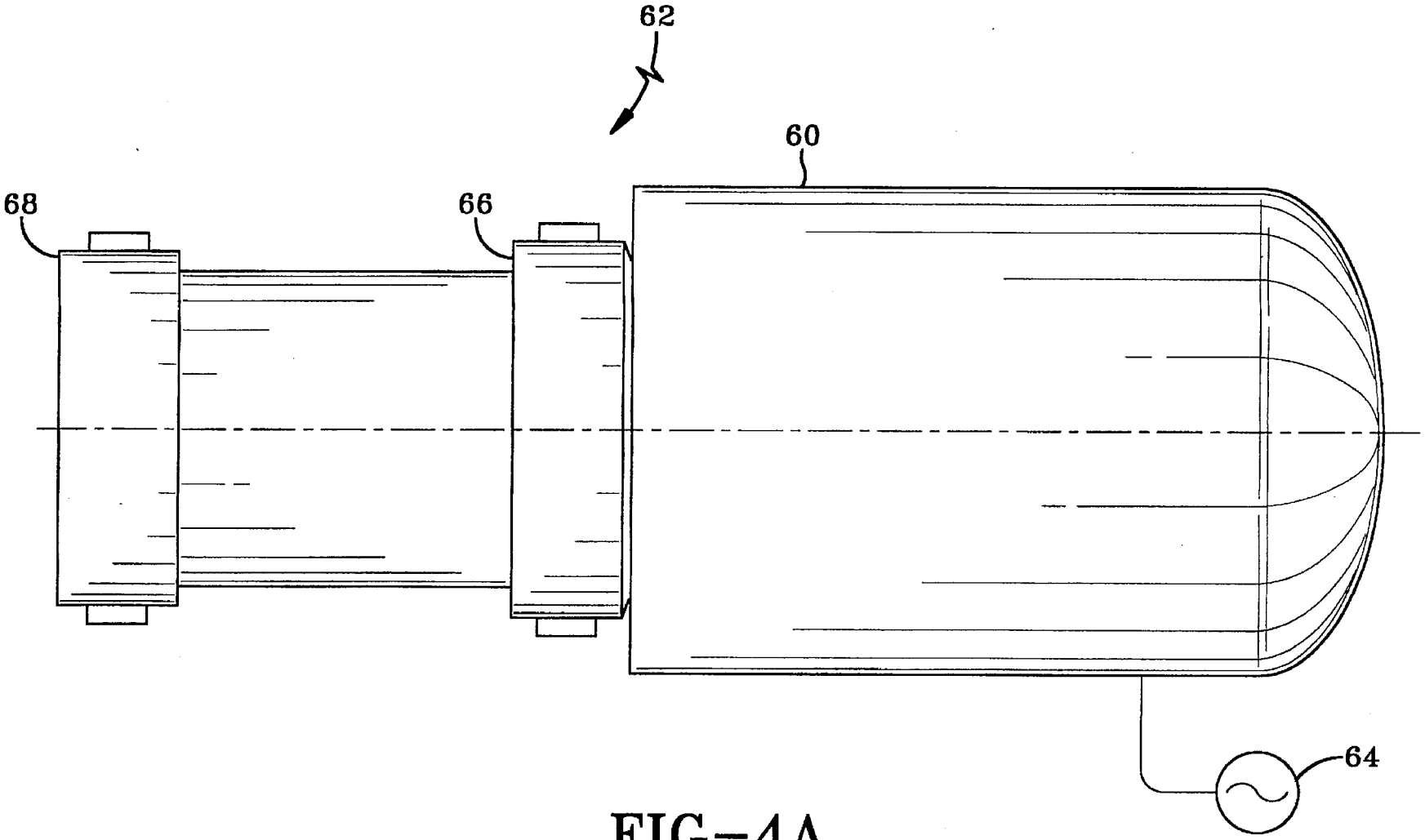
FIG. 4A is a side view of a heat pump and electric motor combination.

FIG. 4A shows a linear electric motor 60 drivingly connected to the preferred free piston Stirling cycle heat pump 62. The linear electric motor 60 is electrically connected to an alternating current source 64. The Stirling heat pump 62 is used in the present invention, housed in housing 42.

As is well known in the art, the Stirling cycle heat pump 62 (of FIG. 4A shown in section in FIG. 4B) has a warm end 66 and a cool end 68, made so by driving a piston 304 and displacer 306 in oscillation at a preselected frequency, which compresses and expands a gas within the heat pump 62. It is fundamentally understood that the cool end 68 of the Stirling heat pump 62 absorbs heat energy from, for example, air having a greater temperature and the warm end 66 dissipates heat to air having lower temperature. The heat energy in the air within the refrigerator cabinet must be conveyed to the cool end 68 of the heat pump 62 so it can be "pumped" out of the refrigerator.

The cool end 68 of the Stirling heat pump 62 can be exposed to the air in the chamber 41 to remove heat from the air in chamber 41. Therefore, no separate heat transporting apparatus or internal heat exchanger (in addition to the cool end 68 of the heat pump which functions as a heat exchanger and heat transporting apparatus) is necessary for the Stirling heat pump in the simplest embodiment of the present invention. Although there is no necessity for an additional internal heat exchanger, it is preferred that an internal heat exchanger 44, as shown in FIG. 2, be used with the Stirling cycle heat pump in the present invention. This is more efficient than using the exposed cool end of the Stirling heat pump to remove heat.

Figure 5:
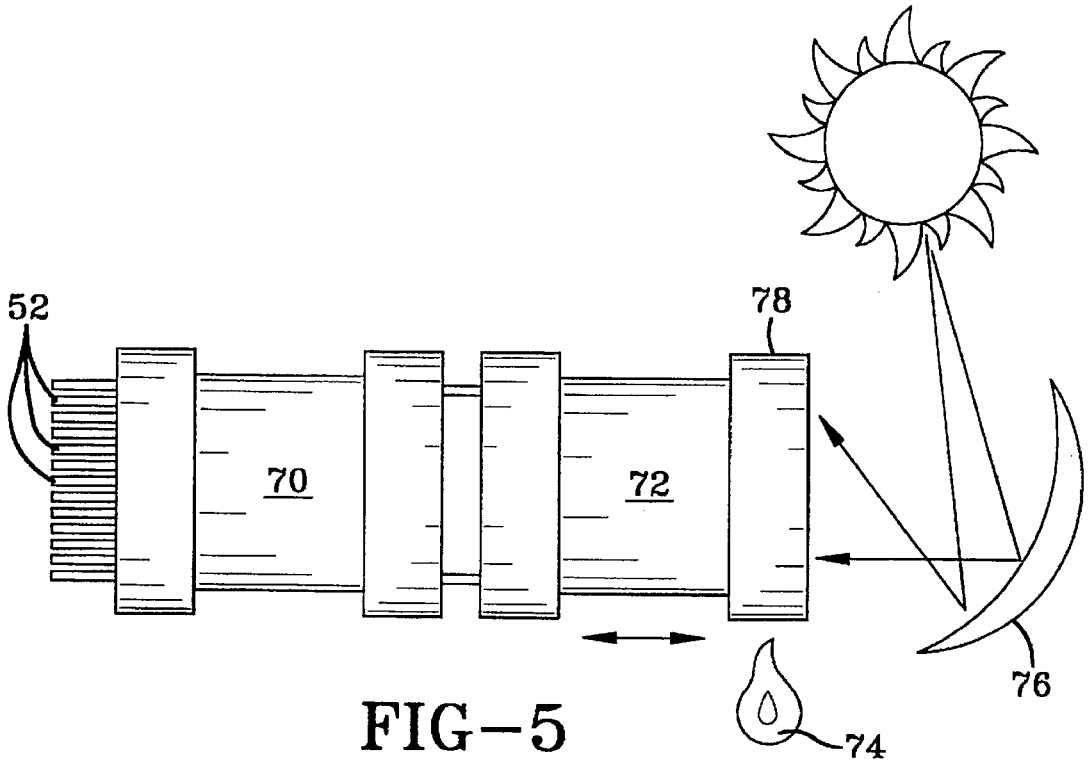
FIG. 5 is a side view of a heat pump and engine combination.
Figure 9:
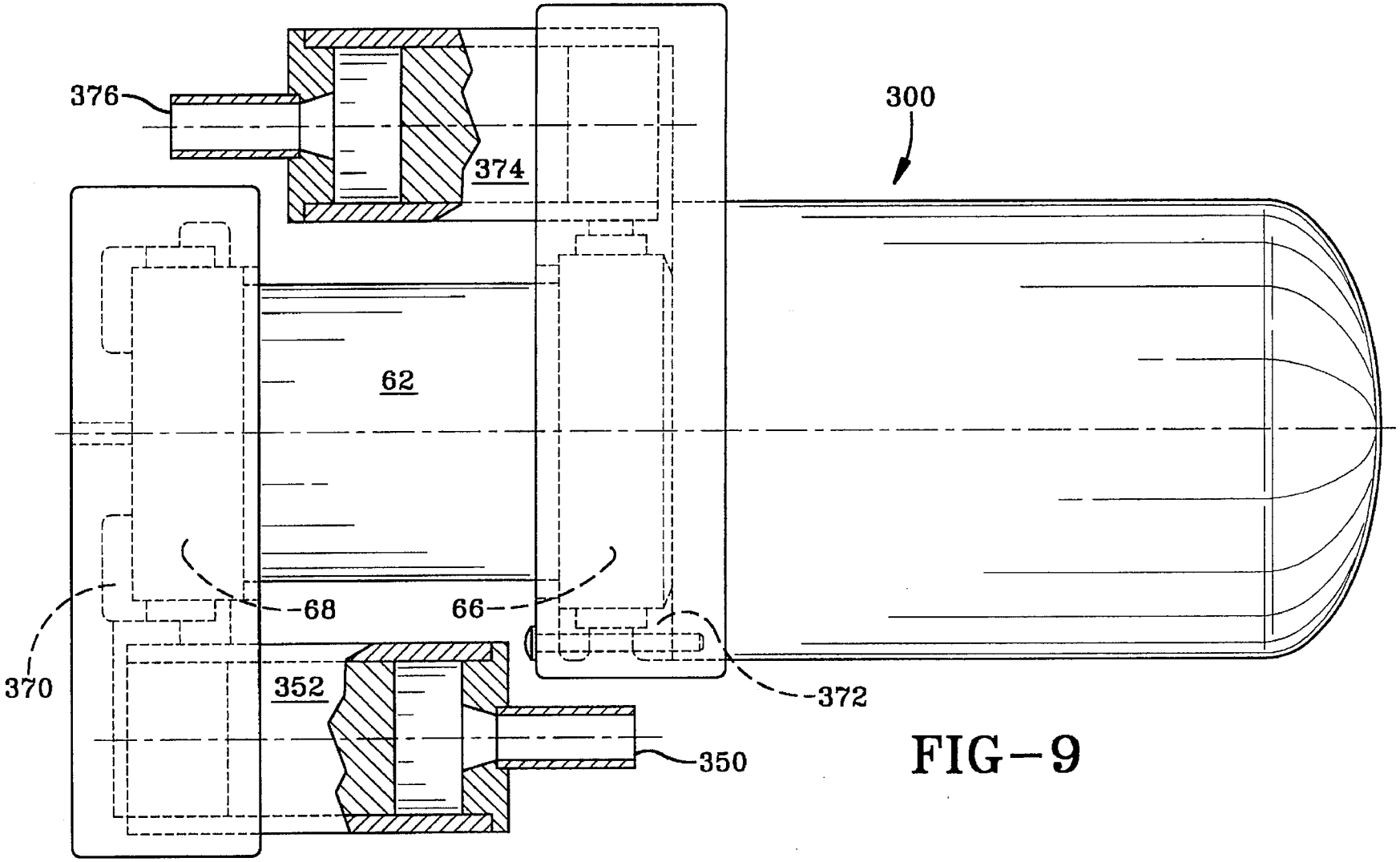
FIG. 9 is a side view in section illustrating a pair of coolant pumps attached to the heat pump of FIG. 4A.

A fluid (preferably non-toxic propylene glycol) which is separate from the gas in the heat pump 62 flows through a closed loop path in thermal contact with the cool end 68 of the Stirling cycle heat pump. In FIG. 9, which shows additional structures attached to the preferred heat pump of FIG. 4A, the heat pump 62 has a heat transporting apparatus inlet 350 which communicates with inertia pump 352. Pump 352 conveys fluid into inlet 350 and out of pump 352 into the cool end 68 of heat pump 62. This fluid is pumped through coolant jacket 370, which has an annular chamber formed around the cool end 68 of the Stirling heat pump 62, and is visible only in FIG. 9. The coolant flowing through the annular chamber is made up of microscopic particles which are convected with in the chamber 370, causing the coolant particles to impinge upon the cool end 68 where they have heat energy conducted from them into the Stirling heat pump 62 and the coolant then flows out of the chamber 370. The coolant next absorbs heat from the air within the refrigerator cabinet by flowing through an internally mounted heat exchanger of high surface area. This heat is absorbed, as the fluid carrying it passes again through chamber 370, by the lower temperature cool end 68 of the heat pump 62. This heat transporting system removes heat from the interior chamber 41 of the refrigerator with greater efficiency than merely exposing the cool end 68 of the Stirling cycle heat pump 62 to the air in the chamber 41. As an alternative to the internal heat transporting system and heat exchanger 44 shown in FIG. 2, a plurality of thin, highly thermally conductive fins 52 can be attached to the cool end of a Stirling cycle heat pump to form a heat exchanger as is shown in FIG. 5.

A heat transporting apparatus which conveys heat energy from the heat pump and dissipates it to the outside of the refrigerator cabinet is always necessary with the present invention. It is necessary because the entire heat pump, which removes heat from the refrigerator, is inside the refrigerator. Therefore, both heat pumped from the refrigerator interior and heat generated by the heat pump must be transported to the outside of the refrigerator.

The external heat transport apparatus has a liquid (preferably a liquid such as water or a water and glycol mixture) in thermal contact with the heat pump. Although it is preferred to use a flowing liquid external heat transporting apparatus, it is possible to merely expose the warm end of the heat pump to the air outside of the refrigerator. This structure would serve to transport heat to the outside of the refrigerator, but would be undesirable for efficiency reasons since heat would not be dissipated very rapidly. Additionally, it is possible to form thermally conductive fins on this exposed warm end of the Stirling heat pump to serve both as the heat transporting apparatus (conducting the heat from the heat pump to the exterior surface of the fins) and as a heat exchanger to dissipate heat to the air which passes in contact with the fins. It is also possible to use an insulated, conductive pathway or a conventional heat pipe as a heat transporting apparatus to remove heat from the refrigerator cabinet. However, fluid mass transport, as in the preferred apparatus, is preferred over conduction for heat energy removal.

Referring again to FIGS. 4B and 9, the liquid in the preferred external heat transporting apparatus flows through an annular chamber 372 surrounding the warm end 66 of the Stirling heat pump 62 and is transported through conduit 50 to a heat exchanger 48 outside the refrigerator cabinet 40 for heat dissipation before returning the liquid to the heat pump to absorb more heat. It is preferred that the pair of coolant pumps 352 and 374 are drivingly connected to the oscillating Stirling heat pump 62 and are driven by the oscillation of the heat pump 62. These pumps 352 and 374 move the liquid coolant in the heat transporting apparatuses through the conduit, annular cooling chambers (which function as a cooling jacket) and heat exchangers of the heat transporting apparatuses.

Pump 374 is an inertia pump, similar to pump 352, and pumps fluid coolant into inlet 376, through annular chamber 372 and through the remainder of the loop of the external heat transporting apparatus.

The liquid coolant in the internal and external heat transporting apparatuses may advantageously be maintained at approximately atmospheric pressure. By using a liquid coolant at approximately atmospheric pressure, substantial advantages exist. Primarily, the strength of the heat transporting apparatus need not be as great as in heat transporting devices under extremely high pressure and dangerous, high pressure leaks are not possible. Since the coolant flows through a cooling jacket surrounding the heat pump, the heat pump is more easily removed and concerns about coolant leakage or contamination of the interior of the heat pump will not exist.

Figure 4B:
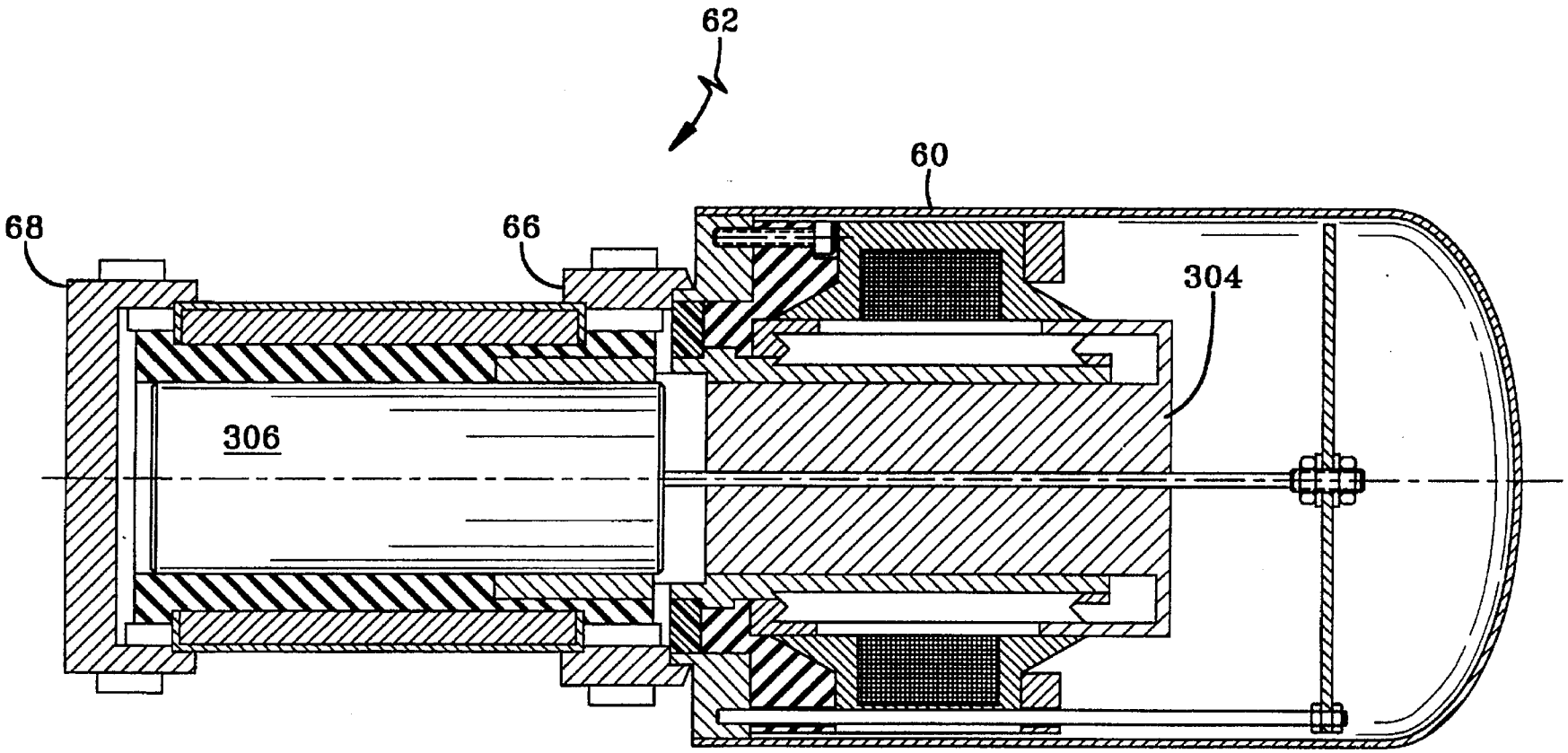
FIG. 4B is a side view in section of the heat pump and electric motor of FIG. 4A.

The Stirling heat pump is preferably driven in its oscillatory motion by a linear electric motor 60 (as shown in FIG. 4B). Alternatively, the Stirling heat pump can be driven by a Stirling cycle engine. Since the Stirling heat pump must be oscillated in order to be driven, any conventional motor could be used to perform this task, whether the motor is electric, hydraulic, fuel powered internal combustion, etc.

Figure 7:
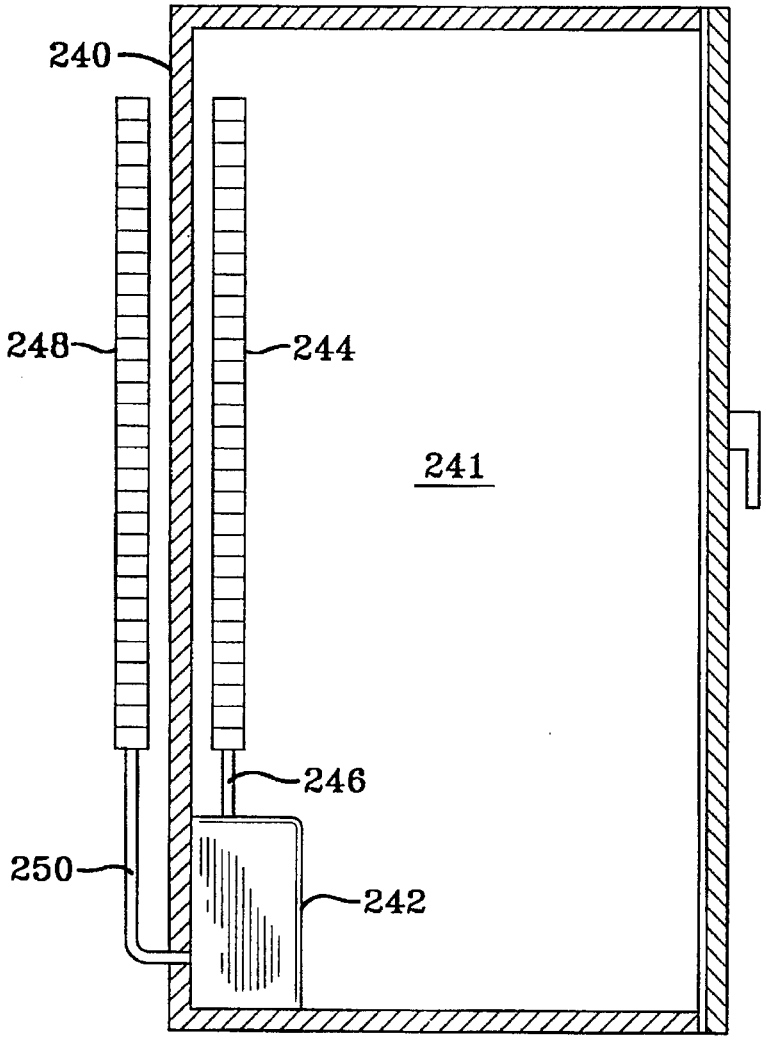
FIG. 7 is a side view in section illustrating an alternative embodiment of the present invention.

Instead of the preferred Stirling cycle heat pump, a Rankine cycle heat pump could be used in the present invention located in housing 242, shown in FIG. 7. The insulating properties of the housing 242 separating the heat pump from the interior chamber 241 would need to be greater, since a Rankine cycle heat pump operates at a substantially higher temperature than a Stirling cycle heat pump. For a Rankine cycle heat pump, it is preferred to use a housing 242 having an evacuated space similar to the refrigerator cabinet 40 of FIG. 2 and cabinet 240 of FIG. 7. This housing 242 would include inner and outer vessels separated by a small gap which is under a vacuum. Since substantially the entire Rankine cycle heat pump operates at higher temperature than the Stirling cycle heat pump, substantially the entire Rankine cycle heat pump is preferably insulated.

The heat energy inside cabinet 240 of FIG. 7 is removed by a heat transporting apparatus with the Rankine cycle heat pump as it was with the Stirling cycle heat pump. The heat transporting apparatus includes an internal heat exchanger 244 connected to the Rankine cycle heat pump through conduit 246 and an external heat exchanger 248 which connects to the heat pump by conduit 250. In the Rankine cycle heat pump, the heat exchangers 244 and 248 and the conduit 246 and 250 must have greater strength and most likely will have other different properties than is required with the Stirling cycle heat pump. This is primarily because of the extremely high pressures developed in the conduit and heat exchangers of a Rankine cycle heat pump as opposed to the approximately atmospheric pressure used in the Stirling cycle heat pump heat transporting apparatus. The conduit and heat exchanger materials may also differ due to chemical differences in the refrigerant or coolant used.

Refrigerant is pumped through conduit 246 into the internal heat exchanger 244 in which it is evaporated. Air passing over the heat exchanger 244 transfers heat to the lower temperature refrigerant. The conduit 250 transports compressed, high temperature refrigerant from the compressor, into the heat exchanger 248 for heat dissipation to the lower temperature air outside the refrigerator. The functioning of the Rankine cycle heat pump regarding compressing and expanding the refrigerant is conventional, and is unchanged by the present invention.

The refrigerant used in the Rankine cycle heat transporting apparatus must be at a pressure substantially greater than atmospheric pressure. This presents disadvantages relative to the Stirling cycle heat pump. The primary disadvantage is that because the pressure of the refrigerant is greater than atmospheric pressure, the conduit used to convey the refrigerant must have higher strength than is required for the Stirling cycle heat transporting apparatuses. Furthermore, because the refrigerant in the Rankine cycle heat pump is an integral part of both the internal and external heat exchangers and the heat pump itself, changes in the heat transporting apparatuses are limited by this integral configuration. Additionally, the refrigerant used in the Rankine cycle heat pump is potentially harmful to the environment.

The maximum temperature of an insulated, Rankine cycle heat pump ideally would be the highest super heat temperature after compression. Since in reality there will be additional heat due to hysteresis, the upper stable temperature will be higher than the highest super heat temperature. The Rankine cycle heat pump must be made to tolerate this higher temperature, and improved or additional heat transporting systems may enhance the feasibility of using the Rankine cycle heat pump.

Several advantages arise from the positioning of the heat pump within the insulated refrigerator cabinet. The internal volume of the refrigerator cabinet is greater when the heat pump is placed within it than when it is outside of the insulated cabinet. Since the internal volume is greater and the surface area of the cabinet is unchanged (and therefore the heat loss is unchanged), the energy used to cool the refrigerator remains the same. This results in an improvement in the energy used per unit volume to cool the interior chamber of the refrigerator.

In a conventional refrigerator, the recess formed in the lower part of the main body of the refrigerator cabinet in which the heat pump is mounted must house the heat pump system parts regardless of their size and must be made with consideration of the manufacture of the whole cabinet. The recess is made to fit all heat pumps, whether they are substantially smaller than the recess or the same size. Therefore, volume is unnecessarily lost since the recess volume is not made to consume merely the volume necessary for the heat pump system. Additionally, manufacturing limitations influence the shape and size of the recess, normally resulting in a recess that consumes the rear portion of the refrigerator cabinet, along the entire width of the cabinet.

The insulated housing for the heat pump can be made free of the limitations of the manufacture of the refrigerator cabinet. Therefore, the heat pump housing can be made as large or small as is necessary to enclose the heat pump and with as little or as much insulation as desired.

Another advantage with the present invention is the improved insulating properties which exist when the refrigerator cabinet does not have the recess. A recess manufactured into an insulated refrigerator cabinet with added bends or welds in the sheet metal makes the cabinet prone to leaks and localized regions of poor insulating properties. By eliminating this recess, the present invention improves the insulating properties in the refrigerator cabinet, and, due to simplification, makes the manufacture of the refrigerator less expensive, since it is a simple rectangular parallelepiped.

Another advantage of the present invention is the reduction of noise audible to anyone near the present invention. Because the heat pump is located entirely within the refrigerator cabinet, the insulation which acts as a barrier to thermal energy transport, also acts as a barrier to the transfer of sound away from the heat pump.

There is also, with the present invention, an increase in usable exterior space for the placement of an external heat exchanger. In a conventional refrigerator, the external heat exchanger is limited in size since it cannot cover the entire rear surface of the refrigerator. This is because access must be allowed to the recessed chamber housing the heat pump. In the present invention, the entire rear surface can have a free convection heat exchanger covering it without leaving a part of the rear surface free, thereby increasing the possible size of the heat exchanger.

Additional advantages exist, such as the fact that a free piston Stirling cycle heat pump can easily be removed from the present invention. Because the coolant of the heat transporting apparatuses is separate from the physical structure of the Stirling heat pump, the heat pump is easily removed from the inside of the refrigerator.

These advantages provide benefits to the placement of a heat pump, and especially a free piston Stirling heat pump, within the interior cooled chamber of a refrigerator. The benefits substantially outweigh the disadvantages of placing a device within the refrigerator which operates at a higher temperature than the desired air temperature within the refrigerator.

It is desirable to provide the refrigerator employing the present invention with a heat sink and source (also called a thermal sink) operating as a cold store to absorb heat from the internal chamber of the refrigerator, especially when no power is available to the heat pump. A preferred cold store is a water filled vessel which is thermally connected to the internal heat transporting apparatus. The heat transporting apparatus removes heat from the cold store during any selected time that the heat pump is removing heat from the inside of the refrigerator. The water in the cold store will preferably freeze and, during times in which no power is available to the heat pump (24 hours or more), absorb heat from the inside of the refrigerator to prevent the temperature within the refrigerator from rising above a preselected temperature. By using a cold store, also called a thermal store, the necessity for batteries is greatly diminished.

As described above, a Stirling heat pump, such as the heat pump 70 shown in FIG. 5 can be drivingly connected to a free piston Stirling cycle engine 72. Power can be provided to the engine 72 by a variety of means, including a hydrocarbon fuel source 74, such as the burning of organic matter, or a solar collector 76 which directs sunlight onto a heated end 78 of the Stirling engine 72.

FIG. 3 illustrates, in a diagram format, the entire cooling apparatus of the preferred embodiment of the present invention. A refrigerator cabinet 100 contains a housing 102 which houses heat pump 104 and a drivingly connected motor 106. An inertia pump 108 which is driven by the oscillating driving force of the motor 106 is connected to a pair of heat transporting conduits 110. These conduits 110 contain a fluid which flows through a coolant loop beginning at the pump 108 passing through one conduit and continuing through external heat exchanger 112, which is positioned outside of the refrigerator cabinet 100. The loop continues through the second conduit 110, through a cooling jacket around the warm end of heat pump 104, and back into pump 108. This is the external heat transporting apparatus.

An internal heat exchanger 114 connects to a second, internal coolant pump 116 by conduits 118. This is an internal heat transporting apparatus functioning similarly to the external heat transporting apparatus, with the addition of a cold store 120 in the loop of the internal heat transporting apparatus.

A photovoltaic panel 122 and inverter 121 (to convert DC current into AC current) are electrically connected to the motor 106 for providing it with electrical power. An alternative, AC (alternating current) power source 123 (shown in phantom) could be electrically connected to the motor 106. Electronic control system 103 connects directly to the photovoltaic panel 122 to control the conversion of DC power from the photovoltaic panel to AC power to drive the cooler, to control the power input to motor 106, and possibly to perform other functions of the refrigerator, such as modulating the heat pump so as to maximize capture of solar energy (insolation) and also to control the internal air temperature by modulation of the AC drive voltage to the heat pump.

Figure 6:
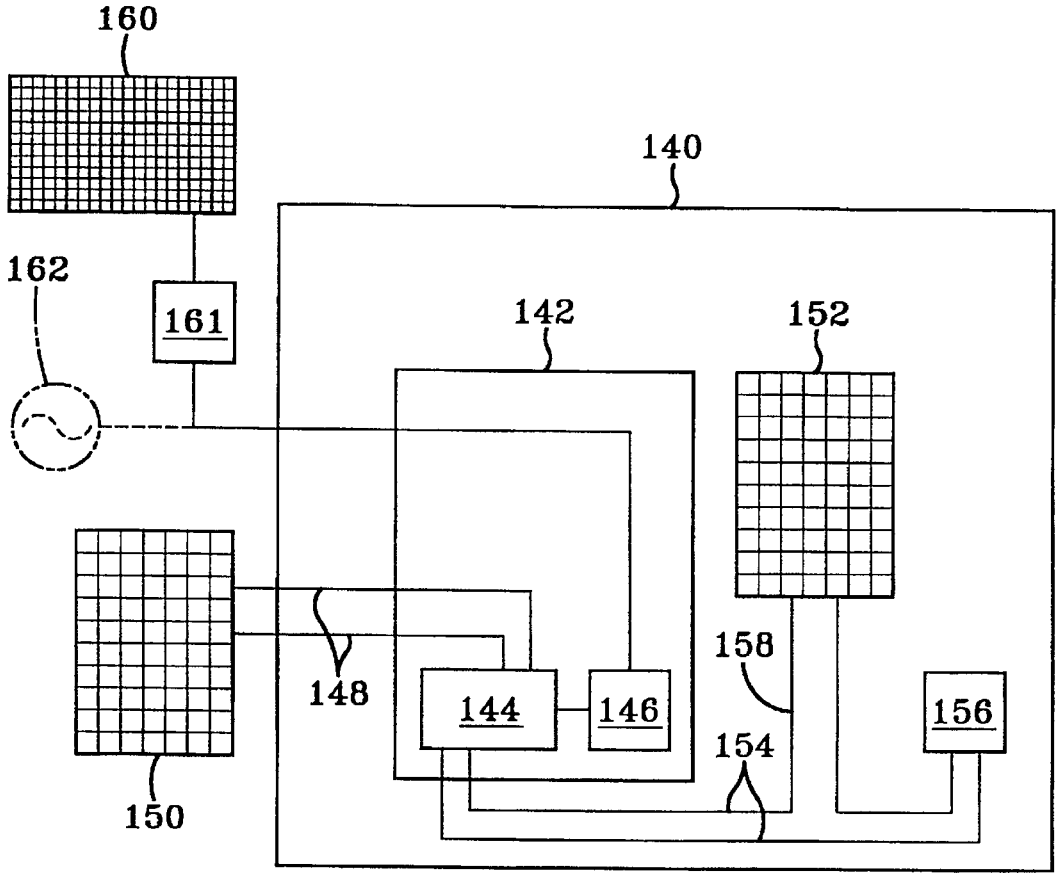
FIG. 6 is a diagrammatic illustration of an alternative embodiment of the present invention.

The Rankine cycle heat pump cooling apparatus is illustrated in FIG. 6 similarly to the preferred embodiment shown in FIG. 3. A refrigerator cabinet 140 contains a housing 142 which houses a compressor 144 and an electric motor 146. The compressor 144 has refrigerant conduits 148 extending from it to an external heat exchanger 150 which functions in the conventional manner. An internal heat exchanger 152 connects to the compressor 144 by conduits 154 in the conventional manner, with the addition of a heat sink 156. An orifice 158 exists near the conduit entrance to the internal heat exchanger 152. Expansion of the compressed refrigerant occurs at the orifice 158, allowing cooled refrigerant to enter the internal heat exchanger 152 in the conventional manner. A photovoltaic panel 160 and inverter 161 electrically connect to the electric motor 146, with alternating current source 162 (shown in phantom) provided as a back-up power source.

While certain preferred embodiments of the present invention have been disclosed in detail, it is to be understood that various modifications may be adopted without departing from the spirit of the invention or scope of the following claims.

We claim:

1. A cooling apparatus comprising:

(a) a receptacle having thermally insulated walls defining a receptacle interior, the receptacle including a closure;

(b) a mechanical heat pump mounted within the receptacle interior;

(c) a heat transporting apparatus, having an external portion which is positioned outside the receptacle and an internal portion connected to the heat pump for transporting heat energy from the heat pump to an exterior of the receptacle.

2. A cooling apparatus in accordance with claim 1, wherein the heat transporting apparatus includes a fluid conduit, containing a fluid, extending between the heat pump and an external heat exchanger.

3. A cooling apparatus in accordance with claim 2, wherein the heat pump is a Stirling cycle thermomechanical transducer.

4. A cooling apparatus in accordance with claim 3, wherein the heat transporting apparatus further comprises:

(a) a coolant recirculation loop within the conduit extending between the Stirling heat pump and the external heat exchanger;

(b) a liquid coolant, in thermal communication with a warm end of the Stirling heat pump, contained within the coolant loop; and (c) a coolant pump interposed along the coolant loop for pumping the liquid coolant through the coolant loop.

5. A cooling apparatus in accordance with claim 4, wherein the coolant pump is drivingly connected to the Stirling heat pump for driving the coolant pump with oscillatory motion of the Stirling heat pump.

6. A cooling apparatus in accordance with claim 4, wherein the liquid coolant has a pressure that is equal to about atmospheric pressure.

7. A cooling apparatus in accordance with claim 4 further comprising an internal heat exchanger positioned inside the receptacle and in thermal communication with a cold end of the Stirling heat pump.

8. A cooling apparatus in accordance with claim 7, wherein the internal heat exchanger comprises a plurality of conductive metal cooling fins connected to the cold end of the Stirling heat pump.

9. A cooling apparatus in accordance with claim 7, wherein the internal heat exchanger thermally communicates with a second heat transporting apparatus within the receptacle, the second heat transporting apparatus comprising:

(a) an internal coolant recirculation loop within a conduit extending between the Stirling heat pump and the internal heat exchanger;

(b) an internal fluid coolant, in thermal communication with the cold end of the Stirling heat pump, contained within the internal coolant loop; and (c) an internal coolant pump interposed along the internal coolant loop for pumping the fluid coolant through the internal coolant loop.

10. A cooling apparatus in accordance with claim 9, wherein the internal fluid coolant is a liquid.

11. A cooling apparatus in accordance with claim 9, wherein the Stirling heat pump is driven by a linear electric motor drivingly connected to the Stirling heat pump.

12. A cooling apparatus in accordance with claim 11, wherein the linear electric motor is electrically connected to an alternating current source.

13. A cooling apparatus in accordance with claim 11, wherein the linear electric motor is electrically connected to a photovoltaic panel.

14. A cooling apparatus in accordance with claim 9, wherein the Stirling heat pump is driven by a Stirling cycle engine drivingly connected to the Stirling heat pump.

15. A cooling apparatus in accordance with claim 14, wherein the Stirling cycle engine is thermally connected to a solar collector.

16. A cooling apparatus in accordance with claim 14, wherein the Stirling cycle engine is thermally connected to a fueled heating source.

17. A cooling apparatus in accordance with claim 9, wherein the internal coolant pump is drivingly connected to the Stirling heat pump for driving the internal coolant pump with oscillatory motion of the Stirling heat pump.

18. A cooling apparatus in accordance with claim 9 further comprising a cold store mounted within the receptacle and connected to the second heat transporting apparatus for absorbing heat energy from within the receptacle.

19. A cooling apparatus in accordance with claim 18, wherein the thermal sink comprises a container of water thermally connected to the second heat transporting apparatus for removing heat energy from the water, thereby cooling it.

20. A cooling apparatus in accordance with claim 19 wherein the water in the cold store is cooled until it freezes.

21. A cooling apparatus in accordance with claim 4, wherein the receptacle contains an expanded polymer thermal insulation.

22. A cooling apparatus in accordance with claim 4, wherein the receptacle includes a vacuum space thermal insulation between an interior and the exterior of the receptacle.

23. A cooling apparatus in accordance with claim 2, wherein the heat pump is a Rankine cycle heat pump comprising a compressor connected to compress fluid and expand it through an orifice.

24. A cooling apparatus in accordance with claim 23, wherein the heat transporting apparatus further comprises:

(a) a coolant recirculation loop within the conduit extending between the heat pump and the external heat exchanger; and (b) a fluid coolant, in thermal communication with the heat pump, contained within the coolant loop.

25. A cooling apparatus in accordance with claim 24 further comprising an internal heat exchanger positioned inside the receptacle and in thermal communication with the heat pump.

26. A cooling apparatus in accordance with claim 25, wherein the internal heat exchanger thermally communicates with a second heat transporting apparatus within the receptacle, the second heat transporting apparatus comprising:

(a) an internal coolant recirculation loop within a conduit extending between the heat pump and the internal heat exchanger; and (b) an internal fluid coolant contained within the internal coolant loop.

27. A cooling apparatus in accordance with claim 26, wherein an electric motor is drivingly connected to the compressor.

28. A cooling apparatus in accordance with claim 27, wherein the electric motor is electrically connected to an alternating current source.

29. A cooling apparatus in accordance with claim 28, wherein the electric motor is electrically connected to a photovoltaic panel.

30. A cooling apparatus in accordance with claim 29 further comprising a cold store mounted within the receptacle and connected to the second heat transporting apparatus for absorbing heat energy from within the receptacle.

31. A cooling apparatus in accordance with claim 30, wherein the cold store comprises a container of water thermally connected to the second heat transporting apparatus for removing heat energy from the water, thereby cooling it.

32. A cooling apparatus in accordance with claim 31 wherein the water in the cold store is cooled until it freezes.

* * * * *